US006338504B1

(12) United States Patent
Hilliard

(10) Patent No.: US 6,338,504 B1
(45) Date of Patent: Jan. 15, 2002

(54) CONNECTOR

(75) Inventor: Paul Hilliard, Aberdeen (GB)

(73) Assignee: National Oilwell (U.K.) Limited, Haywards Heath (GB)

( * ) Notice: Subject to any disclaimer, the term of this patent is extended or adjusted under 35 U.S.C. 154(b) by 0 days.

(21) Appl. No.: 09/341,486

(22) PCT Filed: Jan. 12, 1998

(86) PCT No.: PCT/GB98/00102

§ 371 Date: Aug. 31, 1999

§ 102(e) Date: Aug. 31, 1999

(87) PCT Pub. No.: WO98/30823

PCT Pub. Date: Jul. 16, 1998

(30) Foreign Application Priority Data

Jan. 11, 1997 (GB) ..... 9700521

(51) Int. Cl.[7] ..... F16L 37/00; E21B 43/00

(52) U.S. Cl. ..... 285/3; 285/33; 285/34

(58) Field of Search ..... 285/34, 35, 33, 285/3

(56) References Cited

U.S. PATENT DOCUMENTS

| | | | | | |
|---|---|---|---|---|---|
| 686,390 | A | * | 11/1901 | Cox | 285/34 |
| 2,644,524 | A | * | 7/1953 | Baker | 285/34 |
| 2,737,248 | A | * | 3/1956 | Baker | 285/34 |
| 2,751,019 | A | * | 6/1956 | Baker | 285/34 |
| 2,849,245 | A | | 8/1958 | Baker | |
| 3,255,822 | A | * | 6/1966 | Conrad | 285/34 |
| 3,284,105 | A | * | 11/1966 | Leutwyler | 285/34 |
| 3,291,442 | A | * | 12/1966 | Cranage | 285/34 |
| 3,390,898 | A | * | 7/1968 | Sumida | 285/34 |
| 3,438,654 | A | | 4/1969 | Jackson, Jr. et al. | |
| 3,635,501 | A | * | 1/1972 | Thorne-Thomsen | 285/34 |
| 3,827,728 | A | | 8/1974 | Hynes | |
| 3,842,914 | A | * | 10/1974 | Mott | 285/34 |
| 4,094,539 | A | | 6/1978 | Reimert | |
| 4,172,606 | A | * | 10/1979 | Howe | 285/34 |

FOREIGN PATENT DOCUMENTS

| | | | | |
|---|---|---|---|---|
| FR | 433001 | * | 12/1911 | 285/34 |

OTHER PUBLICATIONS

One (1) page from Bakke Oil Tools Brochure–tool from a approximately 1992.

* cited by examiner

*Primary Examiner*—Eric K. Nicholson
(74) *Attorney, Agent, or Firm*—Ratner & Prestia

(57) ABSTRACT

The connector comprises two body members for respective connection first and second entities, such as tubes, to be connected. The body members are mutually coupled by a first coupling arrangement on the first body member and a second coupling arrangement on the second body member. The first coupling arrangement comprises a number of discrete segments with surfaces defining formation engageable with formation of second coupling arrangement. It also has supports to support the segments in the respective connection positions on the first body member. It also has a release member selectively operable to disable the support to cause or allow the segments to be displaced from their respective connection positions and disengage from the second coupling arrangement thereby mutually disconnecting the first and second body members of the connector.

19 Claims, 8 Drawing Sheets

CONNECTOR

This invention relates to a connector, and relates more particularly but not exclusively to a connector for connecting coiled tubing to a Bottom Hole Assembly (BHA) in a manner allowing for selective action at a remote location to cause the connector to disconnect the coiled tubing from the BHA.

Coiled tubing is a form of non-rigid hollow pipe designed for use in well bores to transmit mechanical torque and tension from a surface location to a BHA or other downhole entity, and to convey hydraulic fluid at pressure along the hollow interior of the tubing. At the same time (and unlike a conventional rigid drillstring), coiled tubing has sufficient flexibility to allow a substantial length of tubing to be stored on a reel in the manner of a hose. (This gives rise to the term "coiled"; in normal use, "coiled" tubing is de-coiled and is more or less straight, at least when in a wellbore).

With the continued and increasing use of coiled tubing for drilling, milling and workover applications in oilfield well-bores there is a need for more reliable and robust equipment which can be attached to the end of coiled tubing depending on the application and the work which is to be performed in the well-bore. Such equipment and tools are generally termed the "Bottom Hole Assembly" or "BHA". On the majority of coiled tubing jobs, irrespective of application or equipment being used, there is the potential for the BHA to become stuck in the well-bore. In order to help alleviate the problems this can cause, certain "emergency release" tools are available which can be used along with the BHA. These emergency release tools or "disconnects" are widely available from many suppliers and are fairly generic in design and method of activation. This familiarity and common design has the advantage that people are familiar in the way they operate and perform so eliminating potential problems that might arise from unfamiliarity with different methods of operation.

Disconnect tools are only utilised in an emergency situation if the BHA becomes stuck and the coiled tubing cannot be removed from the well-bore. The disconnect allows the coiled tubing to be safely parted at a known point within or adjacent the BHA, thus permitting the coiled tubing to be removed from the well-bore and a 'fishing' string to be used to remove the stuck tools separately. This fishing string would latch into a retrieval profile on the lower half of the disconnect tool with a specifically designed pulling tool.

In order to activate the disconnect tool, most known designs require a ball of specific size to be dropped from the surface through the coiled tubing until it reaches a ball seat within the disconnect. Once the ball has reached the disconnect, fluid flow is no longer possible through the coiled tubing. At this point the internal hydraulic pressure in the coiled tubing is increased to activate the release mechanism within the disconnect. This allows controlled separation of the upper and lower parts of the disconnect.

Conventional disconnect tools comprise two body members which are rotationally coupled together by a torque clutch mechanism in the form of corresponding castellations mounted on each coupling face of the body members. The conventional disconnect tools are longitudinally coupled by sprung outwardly loaded fingers which extend through the inner bore from one of the body members, over the castellated coupling, and latch onto a recess on the inner bore of the other body member.

The sprung outwardly loaded fingers are further pushed out, prior to disconnect, by a moveable piston which seats the fingers into the recess. When a ball is introduced, it lands on the piston, and moves the piston so that the fingers are no longer pushed into the recess, and which can move inwardly when the two body members are pulled apart, which disconnects the two body members.

According to the present invention there is provided a connector comprising first and second body members for connection to respective first and second entities to be connected together such that in use of the connector when the first and second body members are connected to the first and second entities respectively, the connector forms a substantially rigid connection between the first and second entities and is capable of transmitting mechanical forces therebetween, the first and second body members being mutually coupled by a first coupling arrangement on the first body member and a second coupling arrangement on the second body member, said first coupling arrangement comprising a plurality of discrete segments having respective segment surfaces which together define a formation engageable with a formation of the second coupling arrangement, and support means to support the segments in respective connection positions on the first body member in which the respective segment surfaces collectively form the first coupling arrangement, and release means selectively operable to disable the support means to cause or allow the segments to be displaced from their respective connection positions and disengage from the second coupling arrangement thereby mutually disconnecting the first and second body members of the connector.

Preferably, the first coupling arrangement is a first screw thread surface, the second coupling arrangement is a second screw thread surface, and the first and second screw thread surfaces are engaged when the first and second body members are connected.

Said segments may each be part-cylindrical. The segment surfaces collectively forming the first screw thread surface may be radially external surfaces of the segments, with the segments being displaced from their respective connection positions in respective directions each including a respective radially inward component. The support means may comprise a retainer member to retain each segment in a respective radially outwardly displaced position, and the release means may comprise retainer withdrawal means selectively operable to withdraw the retainer member from a segment-retaining position so as to allow the segments to move radially inwards and thereby disengage from the second screw thread surface. The retainer member may comprise wedges or slips insertable radially under each segment, and withdrawable by an axial sliding movement. The support means and the release means may be conjoined into a single component or assembly including a normally-open longitudinal through passage selectively closable to allow the application of fluid pressure sufficient to cause the axial sliding movement inducing withdrawal of the retainer member from the segments.

The connector may comprise a capture means to catch the support means after operation of the release means. The capture means is preferable mounted on the first body member.

The segments may be located, in use, within slots, where the slots may be formed on the outer circumference of the first body member. The segments and their respective slots may comprise differing circumferential extents. The segments and their respective slots may comprise a varied width along their longitudinal axis. The segments and their respective slots may comprise tapered side edges which taper in from the radially innermost surface of the segments and their respective slots to the radially outermost surface of the segments and their respective slots.

Typically, the connector further comprises a load bearing member which, in use of the connector, abuts an end of the segments.

The first entity may be coiled tubing and the second entity may be a bottom-hole assembly, the connector functioning as a selectively operable disconnect for separating the coiled tubing from the bottom-hole assembly.

An embodiment of the invention will now be described by way of example, with reference to the accompanying drawings wherein.

Figure 1:
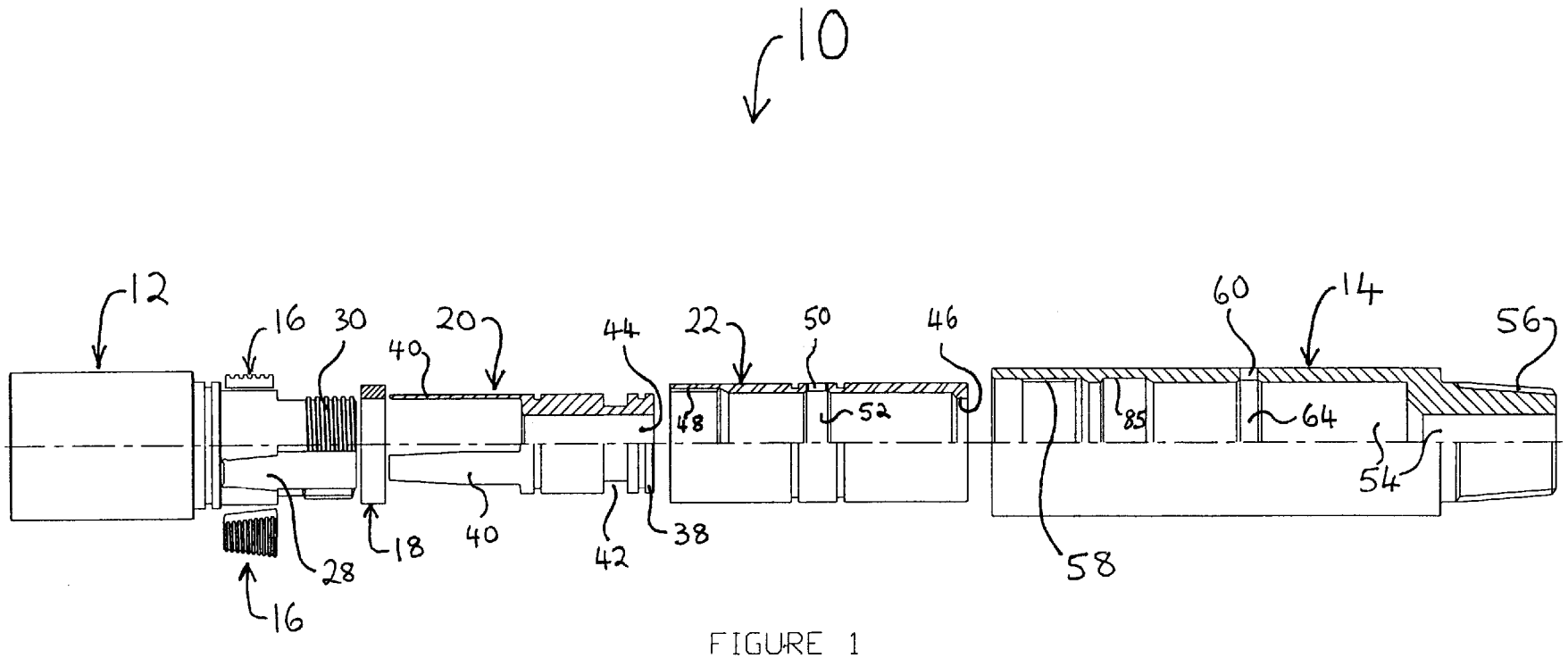
FIG. 1 is an exploded half-sectional longitudinal elevation of a preferred form of connector in accordance with the invention.

Referring first to FIG. 1, this is a half-sectional longitudinal elevation of the mutually separated components of a connector 10.

The components of the connector 10 comprise an upper body member 12 and a lower body member 14, three part-cylindrical segments 16 (only two of which are shown in FIG. 1), a load ring 18, a segment support 20, and a retainer sleeve 22. (Further components, which are not shown in FIG. 1, will be detailed subsequently).

Figure 4:
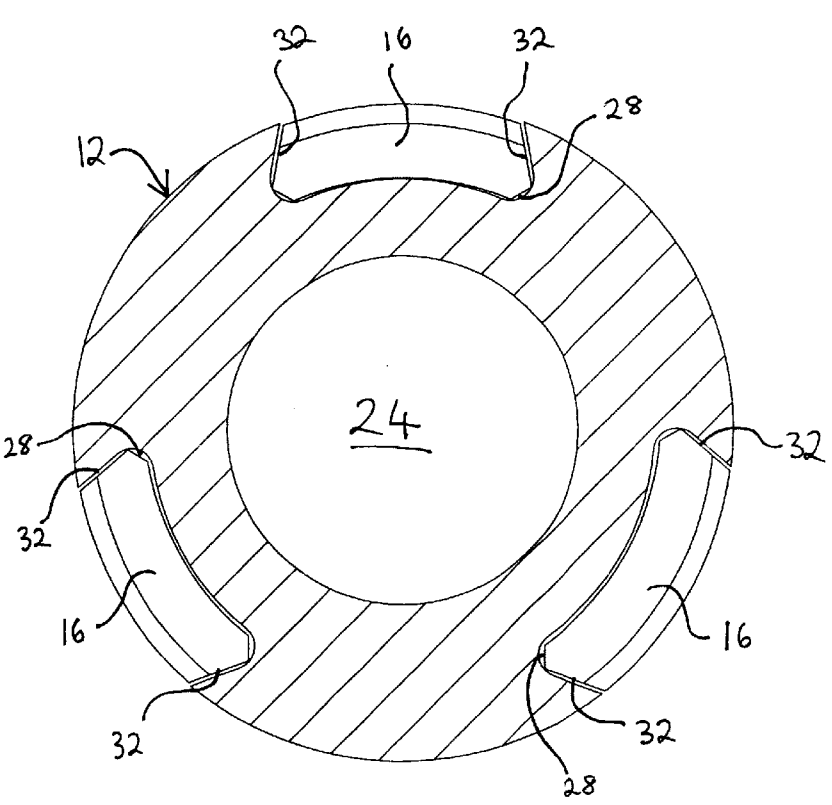
FIG. 4 is a cross-section equivalent to FIG. 3 but showing the reconfiguration of components upon disconnection of the connector.
Figure 3:
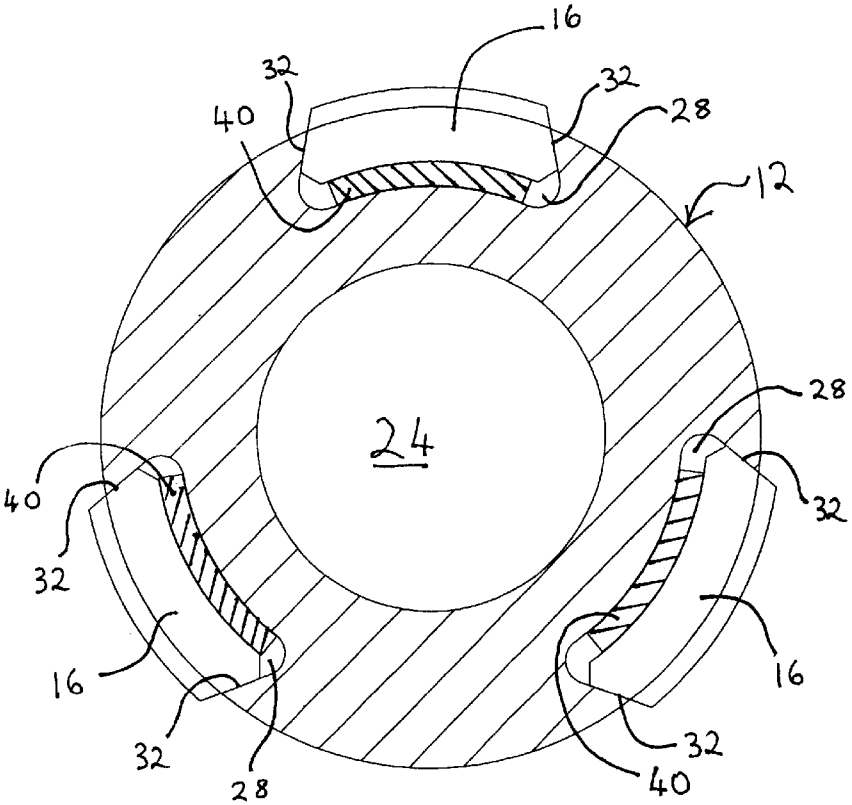
FIG. 3 is a cross-section of the sub-assembly of FIG. 2, taken on the line III—III in FIG. 2.

The upper body 12 is hollow and has a through bore 24 (not visible in FIG. 1 but shown in FIGS. 3 and 4 ). An end of the upper body 12 (the left end as viewed in FIG. 1), which will be the upper end of the connector 10 in use, is internally formed with a standard tapered thread box connector 26 (not visible in FIG. 1 but shown in FIG. 8). The other end of the upper body 12 is formed with three longitudinally extending slots 28 in its periphery, and a screw-threaded portion 30 which is circumferentially interrupted by the slots 28.

The segments 16 each comprise a part-cylindrical member, where the first, second and third segments 16 preferably respectively have a circumferential extent of slightly less than, equal to, and slightly greater than one-sixth of a revolution, and the respective slots 28 are of a matching width. This ensures that only one segment 16 will fit into, and be retained by, each slot 28. The radially outer surface of each segment. 16 is formed with screw-threaded portions, as an interrupted male thread whose lands correspond to the angular width of each segment 16, the pitch circle diameter of this segment thread being somewhat greater than the pitch circle diameter of the thread on the screw-threaded portion 30 of the upper body 12. Each segment 16 has a circumferential extent which renders it a sliding fit in a respective slot 28 (see FIGS. 3 and 4 ), and with each segment 16 only fitting in one slot 28, this ensures that the interrupted male thread formed thereby is always correctly formed.

Also, the slots 28 are preferably formed to have a smaller gap at their upper most, in use, end than their lower most end, and the segments 16 are preferably formed with a correspondingly smaller width at their uppermost end. This ensures that each segment 16 will only fit in its respective slot 28 in one orientation, thereby aiding correct assembly of the connector 10. Also, each segment 16 is preferably formed with tapered side edges 32 which are tapered from the radially innermost to the outermost surface such that the width of the radially innermost surface of the segment 16 is greater than the width of the radially outermost surface of the segment 16. The respective slots 28 are preferably correspondingly tapered, which ensures that each segment 16 is retained within its respective slot 28, and cannot fall radially outwardly therefrom.

The load ring 18 is annular, and comprises three ridges (not shown) which project radially inward to an extent to be a close but slidable fit with the outer surface of fingers 40 (which will be detailed subsequently), and which are circumferentially distributed to also lie within the slots 28.

The segment support 20 comprises an annular portion 38 at its lower end (the right end as viewed in FIG. 1) from which three equi-spaced fingers 40 extend upwards (to the left as viewed in FIG. 1). The fingers 40 are each laterally curved at a constant radius about the longitudinal axis of the segment support 20 (which axis is coincident with the longitudinal axis of the connector 10 as a whole). The inner surface of each finger 40 is a sliding fit over the radially outer surface of a respective slot 28, and the angular extent of each finger 40 renders it an axially sliding fit in its respective slot 28 (see FIG. 3). The annular portion 38 of the segment support 20 is formed with a circumferentially extending external slot 42, for a purpose to be detailed subsequently. The annular portion 40 also has a through bore 44.

The retainer sleeve 22 is generally cylindrical in form, with an inturned lip 46 at its lower end (the right end as viewed in FIG. 1). The inside diameter of the sleeve 22 allows the segment support 20 to be an axially sliding fit inside the sleeve 22 (see FIGS. 5–7 ), except that the inturned lip 46 catches the annular portion 38 and thereby prevents the segment support 20 sliding out of the retainer sleeve 22 when the connector 10 is separating (see FIG. 8). The upper end of the sleeve 22 (the left end as viewed in FIG. 1) is internally formed with a screw thread 48 dimensioned for screw-threaded engagement with the screw-threaded portion 30 on the upper body 12 when the connector 10 is assembled (see FIGS. 5–7). A series of threaded and non-threaded radially extending through holes 50 are circumferentially distributed around the sleeve 22 at about its mid-length. There are six threaded holes 50 and three non-threaded holes 50 distributed around the sleeve 22, for a purpose to be detailed subsequently. The inner surface of the sleeve 22 is relieved around the radially inner ends of the holes 50 by means of a radially shallow circumferential slot 52.

The components 12, 16, 18, 20 and 22 (together with shear pins (not shown in FIG. 1) which fit through the threaded holes 50 and into the slot 42 ) are assembled (as will subsequently be described) to form the upper half of the connector 10. The lower body 14 per se forms the lower half of the connector 10, and will now be described as a separate component.

The lower body 14 is a hollow cylinder and has a through bore 54. An end of the lower body 14 (the right end as viewed in FIG. 1) which will be the lower end of the connector 10 in use, is externally formed with a standard tapered thread pin connector 56. Near the upper end of the lower body 14 (the left end as viewed in FIG. 1), the lower body 14 is internally formed with a screw thread 58 dimensioned for screw-threaded engagement with the screw-threaded outer surfaces of the segments 16 in the assembled connector 10, as will subsequently be detailed. A series of radially extending non-threaded through holes 60 is circumferentially distributed around the lower body 14 at about its mid-length. The inner surface of the lower body 14 is relieved around the radially inner ends of the non-threaded circulation holes 60 by means of a radially shallow circumferential slot 64.

The non-threaded holes 60 of the lower body 14 allow circulation of fluid to occur during separation of the upper 12 and lower 14 bodies, and will be detailed subsequently.

Assembly of the connector components will now be described.

Figure 2:
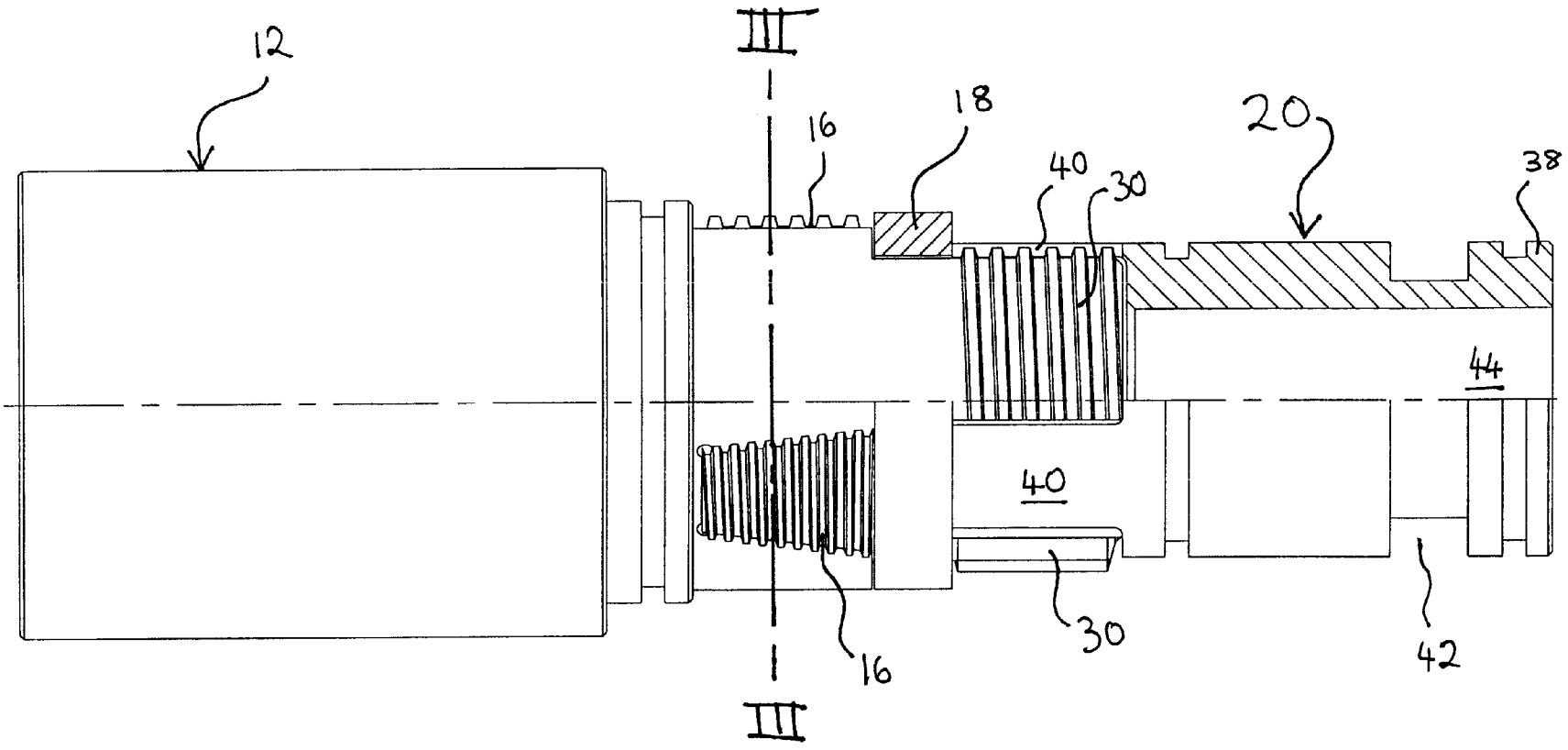
FIG. 2 is a half-sectional longitudinal elevation of a sub-assembly of the connector.

Starting with the individual components shown in FIG. 1, the first few stages of connector assembly are illustrated in FIGS. 2 and 3. The three segments 16 are slid into their respective slots 28; the preferable form and co-operation of the segments 16 and slots 28 ensures that (a) each segment 16 can only correctly fit within, and be retained by one slot 28, (b) each segment 16 can only be inserted into its slot 28 in one orientation, and (c) once fully inserted into its respective slot, each segment 16 cannot fall radially outwardly therefrom. The load ring 18 is then slid over the lower (right) end of the upper body 12 (initially free of other components except for the three segments 16 ) until the three ridges of the load ring 18 are located within the lower (right) end of each slot 28. The load ring 18 is further slid (from right to left) until its uppermost end butts the lowermost (widest) ends of the segments 16. Thus, there is a gap between the radially innermost surface of the ridges and their respective slot 28, into which the respective finger 40 can be slid. Next, the segment support 20 is fitted over the lower end of the upper body 12 such that the fingers 40 slide along the slots 28, until the annular portion 38 abuts the lower end of the upper body 12. At the same time, the fingers 40 have slid through the gap between the ridges of the load ring 18 and the slots 28, and have also slid between the radially innermost surface of the segments 16 and the slots 28. The upper end of the load ring 18 thus provides a load bearing surface for the segments 16, and also prevents them from sliding (from left to right) out of their respective slot 28. The part-assembled configuration is illustrated in FIG. 2 (elevation) and in FIG. 3 (cross-section).

It should be noted at this point that segments 16, the slots 28, and the fingers 40 are such that when the fingers 40 are fully inserted into the slots 28, the segments 16 are held radially outwards to an extent that their threaded outer surfaces stand proud of the upper body 12 as particularly shown in FIG. 3. However, when the fingers 40 are axially withdrawn from the slots 28, the segments 16 are no longer held radially outwards, and it becomes feasible for the threaded outer surfaces of the segments 16 to retract radially inwards to lie substantially flush with the upper body 12, as particularly shown in FIG. 4.

Figure 5:
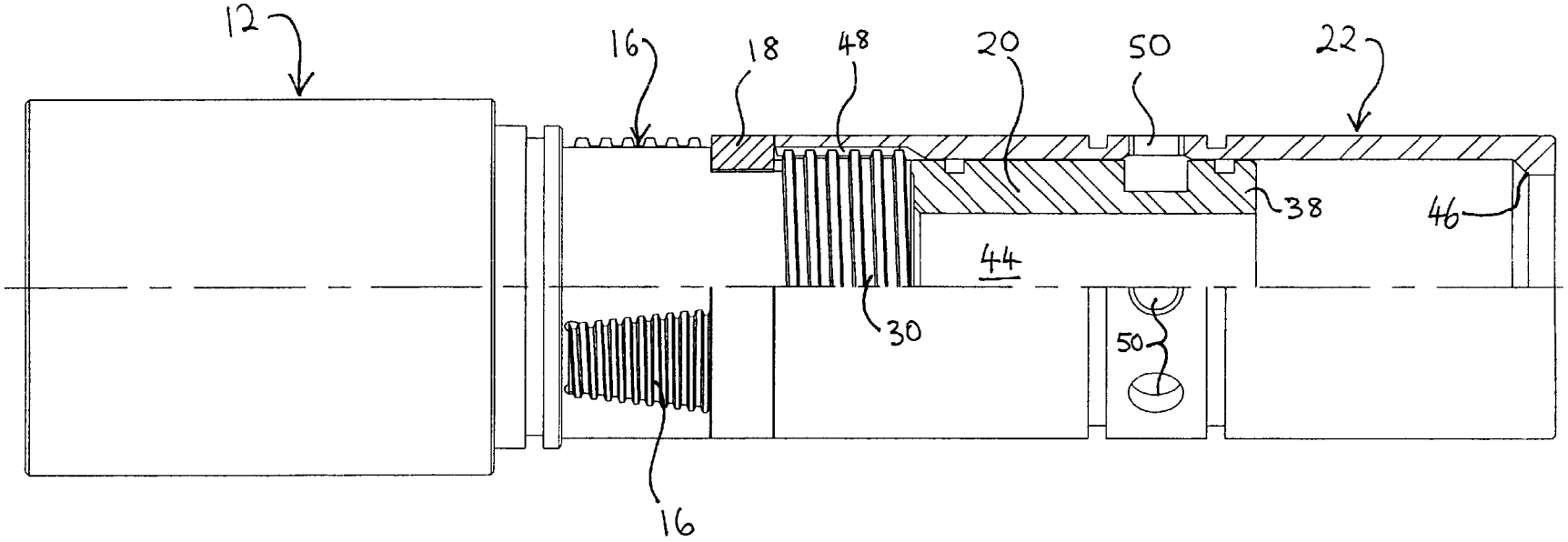
FIG. 5 is a half-sectional longitudinal elevation of the sub-assembly of FIG. 2 with a further component assembled thereon to form one half of the connector.

As the next step in the assembly of the connector 10, the retainer sleeve 22 is screwed on to the intermediate sub-assembly shown in FIG. 2, such that the internal thread 48 on the sleeve 22 forms a screw-threaded connection with the circumferentially interrupted thread of the screw-threaded portion 30 on the upper body 12. When the screw threads 30 and 48 are fully engaged, the upper end of the retainer sleeve 22 (the left end as viewed in FIGS. 1 and 5) butts against the lower end of the load ring 18, and the upper end of the load ring 18 butts against the lower end of the segments 16 as shown in FIG. 5. For the time being, the segments 16 are supported in the particular places on the exterior of the upper body 12, with the underlying fingers 40 of the segment support 20 holding the segments 16 radially outwards, the load ring 18 and the slots 28 together providing axial restraint while also preventing the segments 16 escaping radially outwards. It is arranged that when so anchored, the threaded outer surfaces of the segments 16 collectively form a screw thread for eventual connection with the screw thread 58 in the lower body 14.

To obviate premature withdrawal of the fingers 40 from under the segments 16, the segment support 20 is locked into place within the screwed-on retainer sleeve 22 by means of shear pins (not shown) which are screwed into the threaded holes 50 (which are internally threaded for this purpose) so as to project radially inwards of the holes 50 and into the slot 42 around the annular portion 38 forming the lower end of the segment support 20.

The upper half of the connector 10 is now assembled and ready for mating with the lower half (constituted by the lower body 14 ).

Figure 6:
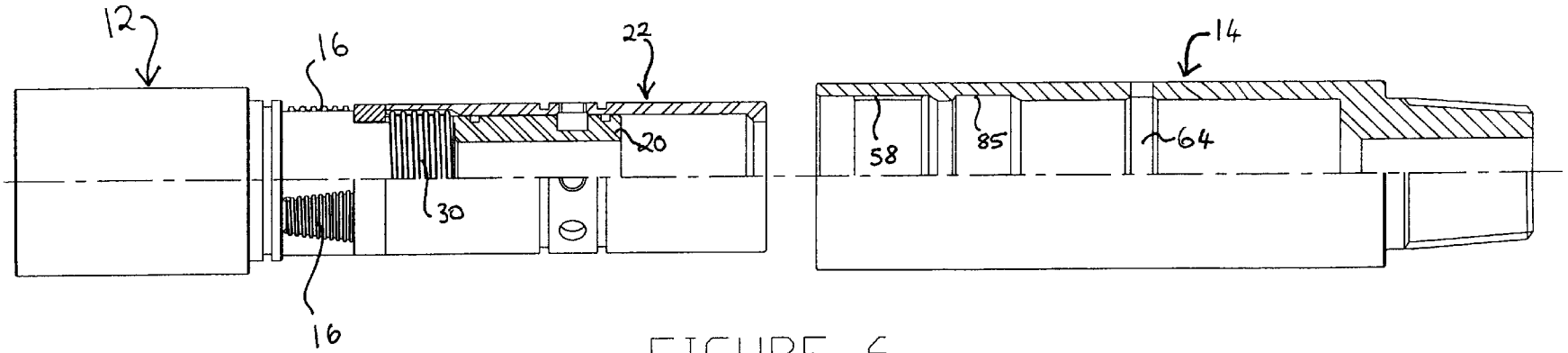
FIG. 6 is a half-sectional longitudinal elevation of the connector half of FIG. 5 being offered the other half of the connector.
Figure 7:
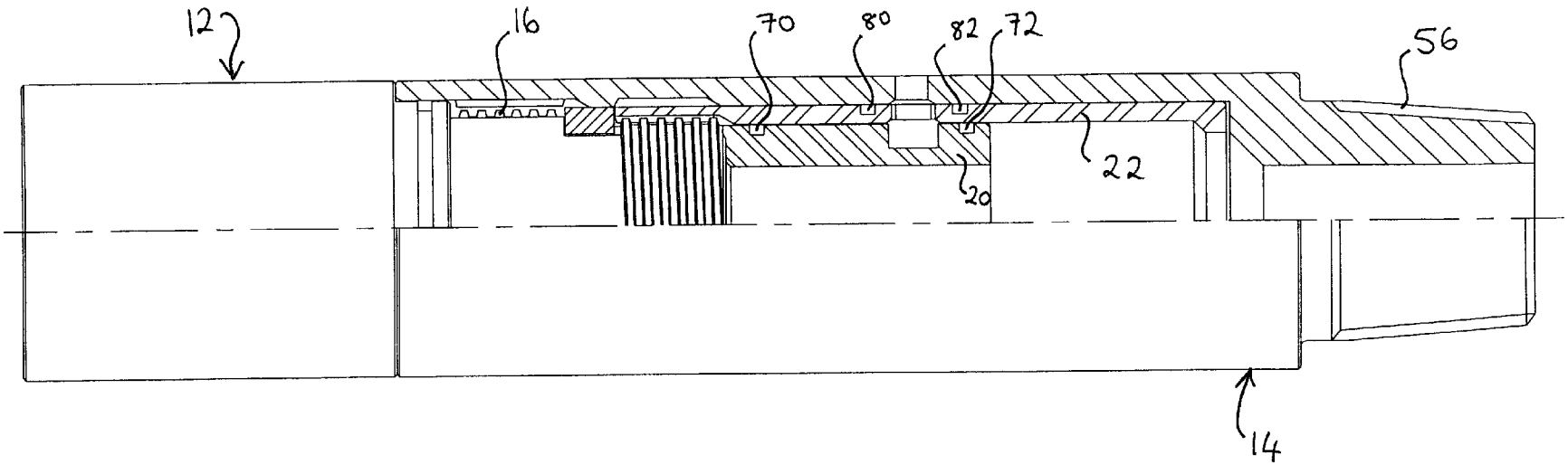
FIG. 7 is a half-sectional longitudinal elevation of the fully assembled connector.

Referring next to FIG. 6, the upper half of the connector 10 (constituted by the FIG. 5 assembly) is presented to the lower body 14, lower end to upper end respectively. The two halves are slid together along their common longitudinal axis until the segments 16 on the upper half contact the internal thread 58 on the lower body 14, whereupon the two halves are relatively rotated to complete the screw-threaded mutual coupling of the two halves of the connector 10, as shown in FIG. 7. The two halves are relatively rotated up to a pre-determined torque, the level of which will normally be the same as, or higher than the torque value of the rest of the screw connections in the string.

The completed connector 10 (as shown in FIG. 7) can have the box connector 26 at the upper end of the coupling 10 connected to the lower end of a coiled tubing 100, and the pin connector 56 at the lower end of the connector 10 connected to a BHA 102 (Bottom-Hole Assembly). Thereby the connector 10 couples the coiled tubing to the BHA 102 in a mechanically rigid manner, which is optimal for down-hole use, while also providing a through passage for pressurised hydraulic fluid by way of the bores 24, 44 and 54. At the same time, the connector 10 allows for disconnection of the coiled tubing 100 from the BHA 102 by action taken on the surface above the well, at a time of the operator's choosing and by a standard procedure, as will now be described.

Figure 8:
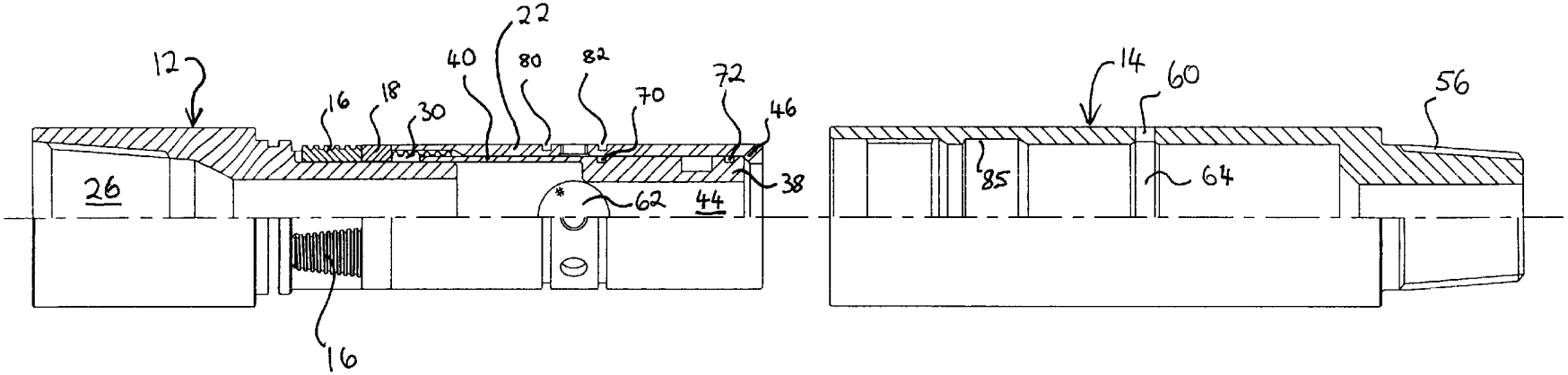
FIG. 8 is a half-sectional longitudinal elevation of the connector in the process of disconnecting.
Figure 9:
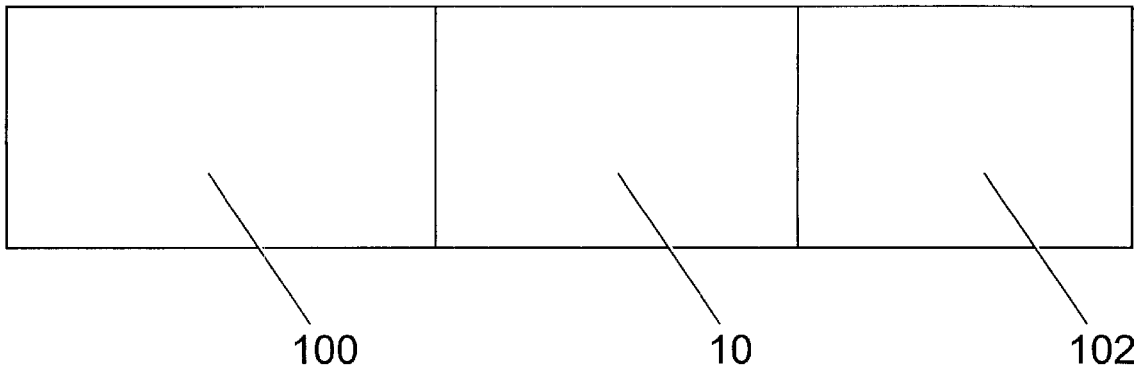
FIG. 9 is a schematic view of the fully assembled connector connected to a Bottom Hole Assembly (BHA) and a coiled tubing.

Referring to FIG. 8, when it is desired to separate the two halves of the connector 10, a dropball 62 of suitable size is introduced into the bore of the coiled tubing at the surface installation above the wellbore in which the connector 10 is deployed. The dropball 62 travels through the bore of the coiled tubing along the length of the tubing, and eventually reaches the connector 10 where it passes through the box connector 26 and the bore 24, coming to rest against the annular portion 38 at the lower end of the segment support 20. The bore 44 through the annular portion 38 is selected to be sufficiently smaller (typically one three thousandth of an inch) than the bore of the coiled tubing, and sufficiently smaller than the bore 24 through the upper body 12, that a dropball 62 of predetermined dimensions can readily reach the interior of the connector 10 but will inevitably be trapped against the lower end of the segment support 20.

With hydraulic passage through the connector 10 blocked by seating of the dropball 62 against the upper rim of the bore 44 through the segment support 20 (as particularly shown in FIG. 8), enough hydraulic pressure can readily be applied down the coiled tubing leading to the upper end of the connector 10 that the piston effectively formed by the combination of segment support 20 and dropball 62 exerts a force on the shear pins projecting radially inwards from the threaded holes 50 into the slot 42 around the segment support 20 sufficient to break these shear pins and so release the segment support 20 from being locked to the retainer sleeve 22. The same hydraulic pressure in the effective piston 20 will force the piston (dropball-blocked segment support) 20 down the sleeve 22, so dragging the fingers 40 down the slots 28 until the fingers 40 no longer underlie the segments 16. Now free of radially outward support, the segments 16 will tend to move radially inwards under their wedging interaction with the screw thread 58, so taking up the positions shown in FIG. 4. Once the segments 16 are free of the screw thread 58, the upper and lower halves of the connector 10 are no longer rigidly coupled, and are free to move apart as depicted in FIG. 8.

However, after the shear pins have been sheared, but before the two halves have reached the level of separation as depicted in FIG. 8, the connector 10 has the ability to circulate fluid from the bore 24 above the piston 20, through the space between the fingers 40, around the circumferential slot 52 on the sleeve 22, through the three non-threaded circulation holes 50 in the sleeve 22, around the circumferential slot 64 on the lower body 14, and out through the non-threaded circulation holes 60 in the lower body 14 into the annulus between the outer surface of the connector 10 and the inner surface of the borehole.

If shear pins have not been inserted into some of the threaded holes 50, then these threaded holes 50 will also aid the circulation of fluid. This circulation of fluid can occur from the time when upper 'O' ring seal 70 mounted in the segment support 20 moves downwardly past the threaded and non-threaded holes 50 in the sleeve 22, until lower 'O' ring seal 82 mounted on the sleeve 22 moves upwardly past the non-threaded holes 60 in the lower body 14. Prior to the ball 62 being dropped down the coiled tubing, the upper 70, 80 and the lower 72, 82 'O' ring seals prevent fluid communication between the bore 24 of the connector 10, and the annulus of the borehole.

The advantage of this circulation function is that the pressure drop of fluid upon commencement of circulation gives an indication to the operator at the surface that the shear pins have been sheared, and the tool is in the process of disconnecting.

This axial separation of the connector halves is not limited, and ultimately the two halves of the connector 10 will completely separate, so releasing the coiled tubing from the BHA.

A retrieval profile 85 is formed on the interior, toward the upper end, of the lower body 14, and after the coiled tubing and upper body 12 have been removed from wellbore, a fishing tool can be inserted into the wellbore to latch onto the retrieval profile 85.

Considered as both a connector for normal use, and an emergency disconnect tool, the various embodiments can yield the following advantages over the prior art:

1 Behaves like a conventional threaded connection until tool is activated;

2 Provides torsional and tensile properties of conventional threaded connection;

3 Elimination of clutches for torque transmission ensures maximum strength under high vibrational loading;

4 Strength and tool life extended due to elimination of vibration on key load-bearing parts;

5 Improved ease of use in the field due to minimum number of parts and no requirement for specialised equipment for assembly or disassembly;

6 Circulation regained once tool is activated giving surface indication that tool has functioned and allowing acid etc to be pumped if required;

7 No overpull required to separate upper and lower sections once the tool has been activated;

8 Short overall length allows it to be used in areas where height restrictions exist;

9 Design allows large through bore whilst maintaining optimum strength;

10 No internal parts remain in the lower body following disconnect, ensuring easy entry by subsequent fishing equipment; and 11 Standard retrieval tool can be used to latch on to the lower body.

While a preferred embodiment of the invention has been described above, the invention is not restricted thereto. For example, a suitable number of segments other than three could be utilised, and alternative shapes of segment supports are possible. Further, the support means could be formed from a suitable alloy known from the art which is dissolved to a substantial extent by passing an electrical current through the connector 10, thus obviating the requirement to drop the ball 62 in order to operate the segment support 20 to disable the fingers 40. Alternatively, the fluid pressure within the bore of the coiled tubing can be increased by a large degree such that the segment support 20 is displaced without the requirement to drop the ball 62. Other modifications and variations can be adopted without departing from the scope of the invention.

What is claimed is:

1. A connector comprising a first and second body members for connection to respective first and second entities to be connected together such that in use of the connector when the first and second body members are connected to the first and second entities respectively, the connector forms a substantially rigid connection between the first and second entities and is capable of transmitting mechanical forces therebetween, the first and second body members being mutually coupled by a first coupling arrangement on the first body member and a second coupling arrangement on the second body member, said first coupling arrangement comprising a plurality of discrete segments having respective segment surfaces which together define a formation engageable with a formation of the second coupling arrangement, and support means to support the segments in respective connection positions on the first body member in which the respective segment surfaces collectively form the first coupling arrangement, and release means selectively operable to disable the support means to cause or allow the segments to be displaced from their respective connection positions and disengage from the second coupling arrangement thereby mutually disconnecting the first and second body members of the connector, wherein the connector further comprises a capture means to catch the support means after operation of the release means.

2. A connector according to claim 1, wherein the first coupling arrangement is a first screw thread surface, the second coupling arrangement is a second screw thread surface, and the first and second screw thread surfaces are engaged when the first and second body members are connected.

3. A connector according to either of claims 1 or 2, wherein said segments are each part-cylindrical.

4. A connector according to claim 2, wherein the segment surfaces collectively forming the first screw thread surface are radially external surfaces of the segments, with the segments being displaced from their respective connection positions in respective directions each including a respective radially inward component.

5. A connector according to any of claims 1 or 2, wherein the support means comprises a retainer member to retain each segment in a respective radially outwardly displaced position.

6. A connector according to claim 5, wherein the release means comprises retainer withdrawal means selectively operable to withdraw the retainer member from a segment-retaining position so as to allow the segments to move radially inwards and thereby disengage from the second screw thread surface.

7. A connector according to claim 6, wherein the retainer member comprises wedges insertable under each segment, and withdrawable by an axial sliding movement.

8. A connector according to claim 7, wherein the support means and the release means are conjoined into a single component or assembly including a normally-open longitudinal through passage selectively closable to allow the application of fluid pressure sufficient to cause the axial sliding movement inducing withdrawal of the retainer member from the segments.

9. A connector according to any of claims 1 or 2, wherein the first entity is coiled tubing and the second entity is a bottom-hole assembly, the connector functioning as a selectively operable disconnect for separating the coiled tubing from the bottom-hole assembly.

10. A connector according to claim 1, wherein the capture means is mounted on the first body member.

11. A connector according to any of claims 1 or 2, wherein the segments are located, in use, within slots.

12. A connector according to claim 11, wherein the slots are formed on the outer circumference of the first body member.

13. A connector according to claim 12, wherein the plurality of segments and their respective slots comprise differing circumferential extents.

14. A connector according to claim 11, wherein the segments and their respective slots comprise a varied width along their longitudinal axis.

15. A connector according to claim 11, wherein the segments and their respective slots comprise tapered side edges which taper in from the radially innermost surface of the segments and their respective slots to the radially outermost surface of the segments and their respective slots.

16. A connector according to any of claims 1 or 2, further comprises a load bearing member which, in use of the connector, abuts an end of the segments.

17. A connector comprising a first and second body members for connection to respective first and second entities to be connected together such that in use of the connector when the first and second body members are connected to the first and second entities respectively, the connector forms a substantially rigid connection between the first and second entities and is capable of transmitting mechanical forces therebetween, the first and second body members being mutually coupled by a first coupling arrangement on the first body member and a second coupling arrangement on the second body member, said first coupling arrangement comprising a plurality of discrete segments having respective segment surfaces which together define a formation engageable with a formation of the second coupling arrangement, and support means to support the segments in respective connection positions on the first body member in which the respective segment surfaces collectively form the first coupling arrangement, and release means selectively operable to disable the support means to cause or allow the segments to be displaced from their respective connection positions and disengage from the second coupling arrangement thereby mutually disconnecting the first and second body members of the connector, wherein the segments are located, in use, within slots, wherein the slots are formed on the outer circumference of the first body member, wherein the plurality of segments and their respective slots comprise differing circumferential extents.

18. A connector comprising a first and second body members for connection to respective first and second entities to be connected together such that in use of the connector when the first and second body members are connected to the first and second entities respectively, the connector forms a substantially rigid connection between the first and second entities and is capable of transmitting mechanical forces therebetween, the first and second body members being mutually coupled by a first coupling arrangement on the first body member and a second coupling arrangement on the second body member, said first coupling arrangement comprising a plurality of discrete segments having respective segment surfaces which together define a formation engageable with a formation of the second coupling arrangement, and support means to support the segments in respective connection positions on the first body member in which the respective segment surfaces collectively form the first coupling arrangement, and release means selectively operable to disable the support means to cause or allow the segments to be displaced from their respective connection positions and disengage from the second coupling arrangement thereby mutually disconnecting the first and second body members of the connector, wherein the segments are located, in use, within slots, wherein the segments and their respective slots comprise a varied width along their longitudinal axis.

19. A connector comprising a first and second body members for connection to respective first and second entities to be connected together such that in use of the connector when the first and second body members are connected to the first and second entities respectively, the connector forms a substantially rigid connection between the first and second entities and is capable of transmitting mechanical forces therebetween, the first and second body members being mutually coupled by a first coupling arrangement on the first body member and a second coupling arrangement on the second body member, said first coupling arrangement comprising a plurality of discrete segments having respective segment surfaces which together define a formation engageable with a formation of the second coupling arrangement, and support means to support the segments in respective connection positions on the first body member in which the respective segment surfaces collectively form the first coupling arrangement, and release means selectively operable to disable the support means to cause or allow the segments to be displaced from their respective connection positions and disengage from the second coupling arrangement thereby mutually disconnecting the first and second body members of the connector, wherein the segments are located, in use, within slots, wherein the segments and their respective slots comprise tapered side edges which taper in from the radially innermost surface of the segments and their respective slots to the radially outermost surface of the segments and their respective slots.

* * * * *